US011051101B1

(12) United States Patent
Weedon

(10) Patent No.: US 11,051,101 B1
(45) Date of Patent: Jun. 29, 2021

(54) VEHICLE SUBWOOFER SYSTEM AND METHOD OF USE

(76) Inventor: Michael D. Weedon, Palm Coast, FL (US)

( * ) Notice: Subject to any disclaimer, the term of this patent is extended or adjusted under 35 U.S.C. 154(b) by 985 days.

(21) Appl. No.: 13/599,562

(22) Filed: Aug. 30, 2012

(51) Int. Cl.
*H04R 5/02* (2006.01)

(52) U.S. Cl.
CPC ..... *H04R 5/02* (2013.01)

(58) Field of Classification Search
CPC .... H04R 5/02; H04R 2499/13; H04R 29/001; H04R 3/00; B60R 11/0217; B60R 16/03
USPC ..... 381/71.4, 86, 302
See application file for complete search history.

(56) References Cited

U.S. PATENT DOCUMENTS 4,572,326 A * 2/1986 Hutchins ..... B60R 11/0217 181/150
4,815,991 A * 3/1989 Bakke ..... 439/502
5,635,912 A 6/1997 McCracken
6,418,231 B1 * 7/2002 Carver ..... 381/395
6,501,277 B1 * 12/2002 Sybesma ..... 324/503
6,868,937 B2 3/2005 Cass
7,050,593 B1 5/2006 Emerling et al.
7,853,025 B2 12/2010 Sleboda et al.
8,068,617 B2 11/2011 Katayama et al.
2003/0103634 A1 6/2003 Ito
2004/0027001 A1 * 2/2004 Reed, III ..... 307/10.1
2006/0005694 A1 * 1/2006 Waller, Jr. ..... H03G 3/00 84/736
2006/0285695 A1 * 12/2006 Keys ..... 381/59
2007/0087784 A1 * 4/2007 Yamamoto et al. ..... 455/557
2007/0217242 A1 * 9/2007 Dayan et al. ..... 363/146
2009/0110211 A1 * 4/2009 Feit ..... 381/86
2009/0190773 A1 7/2009 Katayama et al.
2012/0081067 A1 * 4/2012 Burrell, IV ..... 320/107
2012/0263337 A1 * 10/2012 Sakamoto ..... H04R 7/12 381/398

(Continued)

FOREIGN PATENT DOCUMENTS

JP 2013151193 A * 8/2013

OTHER PUBLICATIONS

Elenco, Elenco Electronics TL-5, May 10, 2004, Amazon http://www.amazon.com/Elenco-Electronics-TL-5-Banana-Alligator/dp/B0002JJU1O/ref=pd_sim_sbs_hi_1?ie=UTF8&refRID=0VPP3Y1CX0WNPDBD0D7M.*

(Continued)

*Primary Examiner* — Norman Yu
(74) *Attorney, Agent, or Firm* — Law Office of Mitchell Ghaneie, P.A.; Mitchell Ghaneie; Christopher Roberts

(57) ABSTRACT

A vehicle subwoofer system and method of use. The subwoofer system includes a powered subwoofer electrically connected to a vehicle speaker through an input line assembly, an inverter deriving power from the vehicle DC power system through a DC power line, and the inverter powering the subwoofer through an AC power line. In the preferred embodiment, the input line assembly incorporated alligator clips to quickly and easily connect to speaker contacts, and the DC power line included a DC power plug to quickly and easily plug into a vehicle DC power receptacle. Method steps include electrically connecting the input line assembly to the vehicle speaker, electrically connecting the powered subwoofer to the inverter through the AC power line, electrically connecting the DC power line to the vehicle DC power source, and a listener enjoying reinforced bass sound from the subwoofer derived from the vehicle speaker.

6 Claims, 3 Drawing Sheets

(56) References Cited

U.S. PATENT DOCUMENTS

2012/0318416 A1* 12/2012 Siciliano ..... B60J 11/04
150/166

OTHER PUBLICATIONS

Elenco, "Elenco TL-5, Length 36-Inch Banana Alligator Lead Set," May 5, 2004 (Year: 2004).*
Visonik VB212PKG Dual Subs Amplified System description (1 page).
Vibe Audio LiteAir Compact 12 description (1 page).
1600W Kenwood + Autotex Bass Package description (1 page).
Bazooka Big EZ Bass description (1 page).
Visonik VB12A 800Watt 12" Car Subwoofer description (1 page).
XXX Car Audio Pair 12" Subs/Car Amp Kit description (1 page).
Polk Audio PSW Series PSW10 Black 10-inch Powered Subwoofer description (1 page).
Enercell™ 350W High-Power Inverter with USB description (1 page).

* cited by examiner

VEHICLE SUBWOOFER SYSTEM AND METHOD OF USE

BACKGROUND OF THE INVENTION

Field of the Invention

This invention relates to vehicle audio systems, and in particular to a vehicle subwoofer system and method of use.

Background of the Invention

Vehicle audio systems had their origins in the form of an AM radio installed in the instrument panel of a vehicle. Such radios were simple, monaural devices which typically incorporated a single speaker into the radio itself.

Since then, vehicle audio systems have evolved. Signal sources include AM and FM radios, satellite radios, CD players, tape players of various kinds, digital recorders, and even local wireless transmissions from a variety of digital players to the unit mounted in the vehicle instrument panel.

Similarly, the quality and frequency response of sound reinforcement incorporated into vehicle audio systems has increased dramatically. Today's vehicle audio systems are capable of producing multi-channel sound reproduction and reinforcement such as stereo, quadraphonic, and a wide variety of multi-speaker stage environments. The speakers themselves have improved response band frequencies as well as power-handling capabilities from the amplifiers in the vehicle audio system.

Currently available speakers typically include two or three separate speakers in each speaker assembly, in order to more accurately project high, mid, and low frequency sound. Such speaker assemblies are referred to as two-way and three-way speakers.

Extreme low frequencies require relatively large speakers to project the long wavelengths associated with low frequency sound waves, such as the bass part in a musical composition. Specialized low-frequency speakers called subwoofers are used for this function. They are large, dedicated speakers, which typically require their own amplifier powerful enough to drive the subwoofer.

Because of their size requirements, subwoofers are typically not installed at the factory, but are rather an aftermarket installation for vehicles such as passenger cars, pickup trucks, vans, etc. A sedan subwoofer installation, for example, would usually place the subwoofer enclosure in the trunk of the car, because that is generally the only space large enough to accommodate the dimensions of the subwoofer enclosure.

Currently available aftermarket subwoofer installations involve a great deal of labor, in that wiring must be installed from the audio control unit mounted in the vehicle instrument panel, back through the body of the vehicle, to the trunk. Then electrical power must be wired into the subwoofer amplifier from the [typically] 12 volt vehicle electrical system. Thus, conventional subwoofer installations involve a significant installation labor cost above and beyond the cost of subwoofer/amplifier package itself. Therefore, it would be desirable to provide an easily-installed subwoofer package which substantially reduces the labor component of the installation cost.

Existing Designs.

A number of applications have been made, and patents issued, for vehicle audio systems incorporating subwoofers. For example, patent applications with publication numbers 2009/0190773 and 2003/0103634 were made by Katayama et al. and Ito respectively, and U.S. Pat. No. 8,068,617 was issued to Katayama et al., for permanently installed vehicle audio systems. These suffered from the disadvantages referred to above, that is, labor-intensive and time-consuming, and therefore expensive, installation.

A number of subwoofer kits are commercially available. These include a subwoofer speaker, an amplifier, twenty or thirty feet of speaker wire, and electrical power wire. The installer is required to thread speaker wire through the vehicle frame from the front instrument panel to the rear of the vehicle, and then wire the subwoofer amplifier into the vehicle electrical system. These subwoofer kits suffered from the afore-mentioned disadvantages, specifically, labor-intensive and time-consuming, and therefore expensive, installation.

Thus, it would be desirable to provide a vehicle subwoofer system and method of use which is quick and easy to install, which does not require installation of speaker wire through most of the length of a vehicle frame, and which does not require wiring the amplifier of the subwoofer into the vehicle electrical system in order to power the amplifier.

SUMMARY OF THE INVENTION

Accordingly, it is an object of the present invention to provide a vehicle subwoofer system and method of use whose installation does not require installing speaker wire through the vehicle frame from the front instrument panel to the rear of the vehicle. Design features allowing this object to be accomplished include a powered woofer connected to a vehicle DC power receptacle through an inverter, and to a speaker by input wires. Advantages associated with the accomplishment of this object include reduced subwoofer system installation time, and associated installation cost savings.

It is another object of the present invention to provide a vehicle subwoofer system and method of use whose installation does not require permanently wiring the subwoofer amplifier into the vehicle electrical system. Design features allowing this object to be accomplished include a powered woofer connected to a vehicle DC power receptacle through an inverter. Advantages associated with the accomplishment of this object include reduced subwoofer system installation time, and associated installation cost savings.

It is still another object of this invention to provide a subwoofer system and method of use which is simple to install, and whose installation requires no specialized knowledge or skills Design features enabling the accomplishment of this object include a powered subwoofer connected to a vehicle DC power receptacle through an inverter using the inverter's DC power line and DC power plug, and to a speaker by input wires terminating in quick-attach clips such alligator clips. Advantages associated with the realization of this object include quick and easy installation, and the associated installation cost savings.

It is yet another object of this invention to provide a subwoofer system and method of use which is inexpensive. Design features allowing this object to be achieved include the use of commercially available components, and components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIG. 1. Sheet two contains FIG. 2. Sheet three contains FIG. 3.

DETAILED DESCRIPTION OF THE PREFERRED EMBODIMENT

Figure 1:
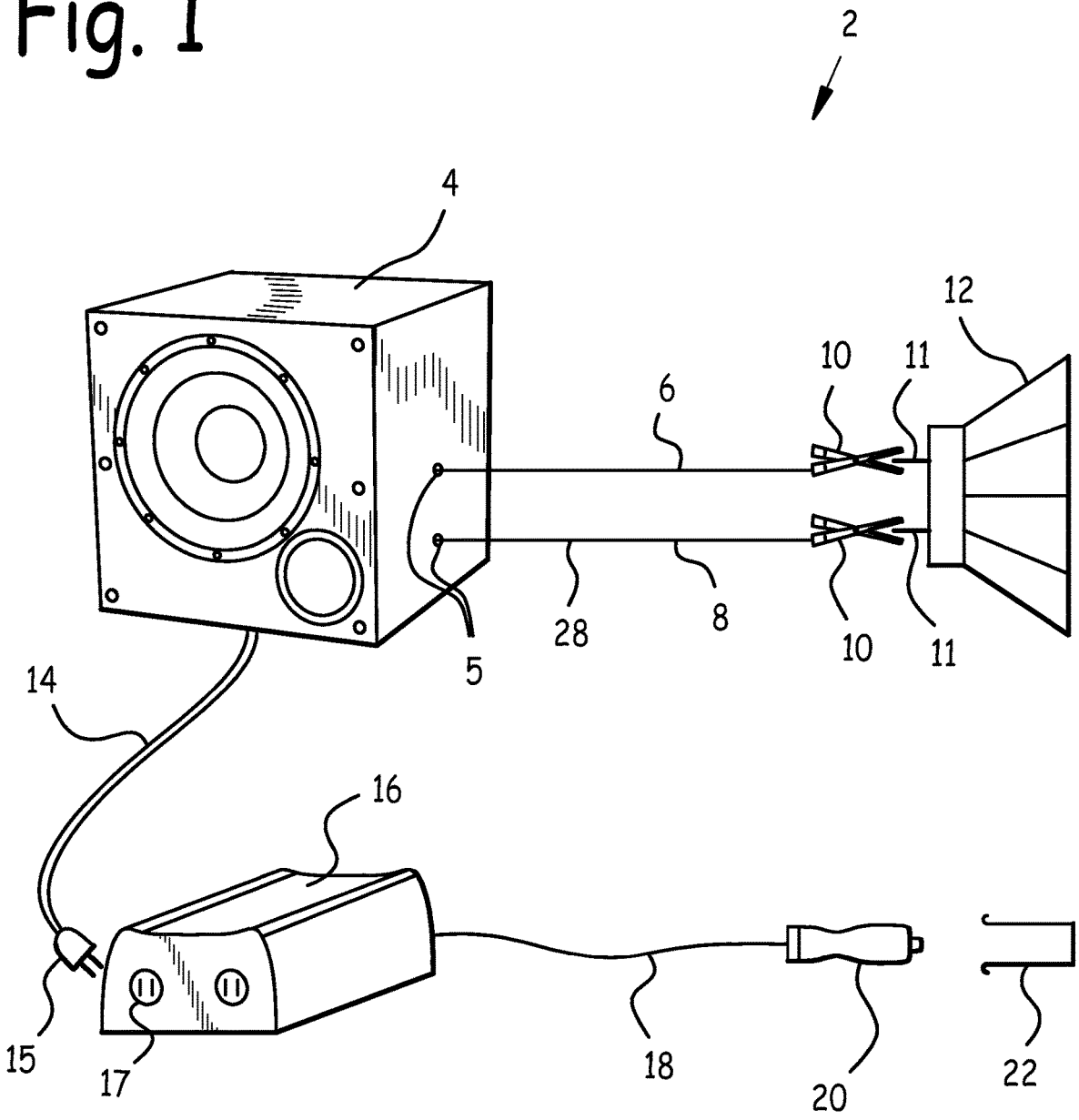
FIG. 1 is a schematic view of a vehicle subwoofer system.

FIG. 1 is a schematic view of vehicle subwoofer system 2. As may be observed in this figure, vehicle subwoofer system 2 is made up of powered subwoofer 4 electrically connected to a vehicle DC power source 22 through inverter 16, and to speaker 12 by means of input line assembly 28. In general, throughout this disclosure, "DC" refers to direct current, and "AC" refers to alternating current. Powered subwoofer 4 incorporates subwoofer audio input 5 and AC power line 14.

Speaker 12 is part of an existing vehicle audio system, whose speaker contacts 11 may extend into the trunk of a vehicle into which the instant subwoofer system is to be installed, and thus speaker contacts 11 may be readily available to which to attach alligators clips 10.

Figure 3:
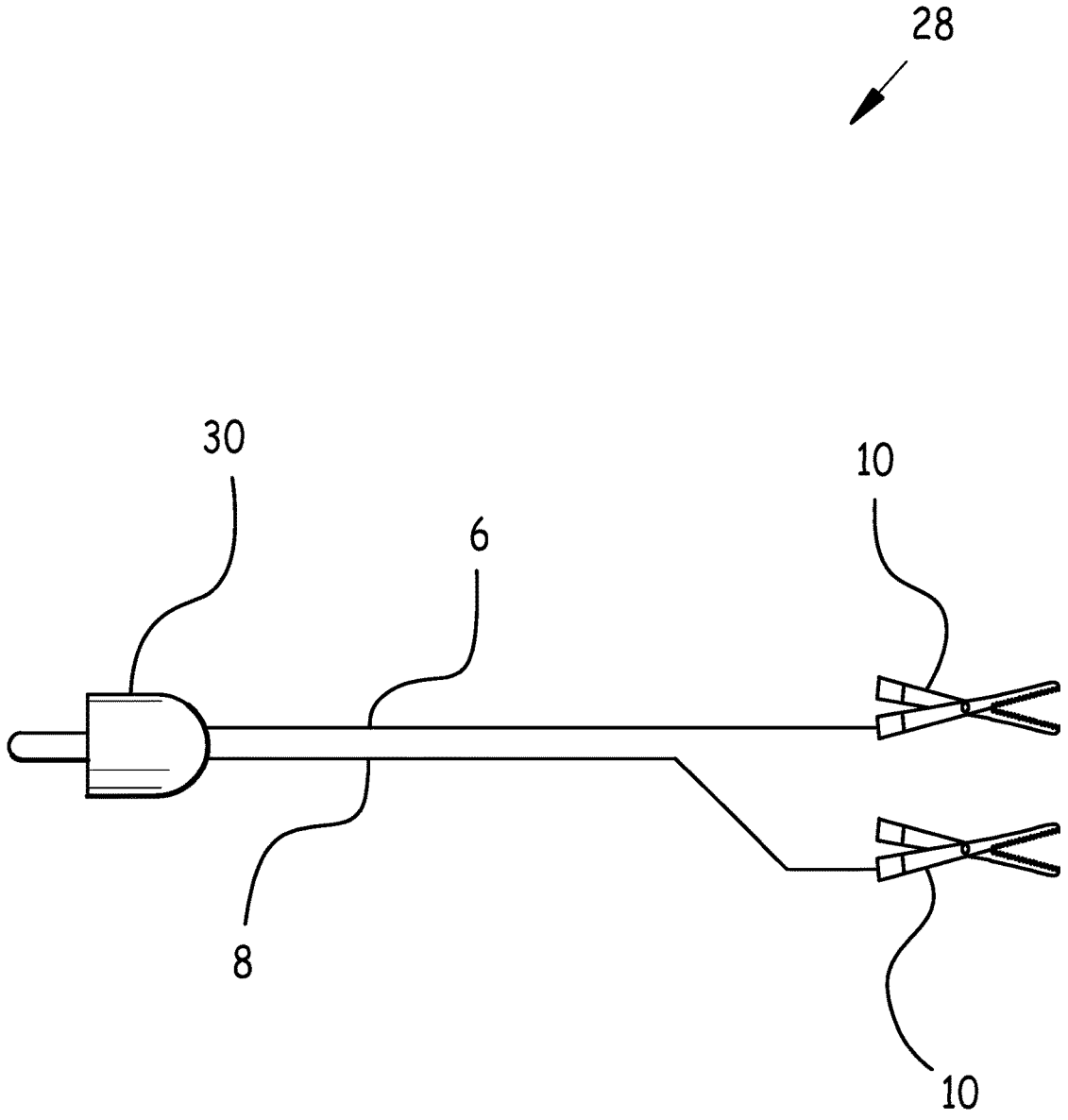
FIG. 3 is a top view of an exemplary embodiment of an input wire assembly.

FIG. 3 is a top view of an exemplary embodiment of input wire assembly 28.

Although it is intended to fall within the scope of this disclosure that any appropriate type of input wire assembly 28 be used, the embodiment of input wire assembly 28 illustrated in FIG. 3 includes a positive input wire 6 and a negative input wire 8 extending from an alligator clip 10 at one end of each, to an audio plug 30 at their opposite end.

Audio plug 30 may be a phono jack, an RCA plug, or any other appropriate audio plug to connect to subwoofer audio input 5. Where powered subwoofer 4 incorporates wire conductor clamps in its audio input 5, input wire assembly 28 may dispense with audio plug 30, and merely incorporate an appropriate length of positive input wire 6 and negative input wire 28 at ends opposite alligator clips 10, unsheathed for clamping at their ends opposite alligator clips 10.

Figure 2:
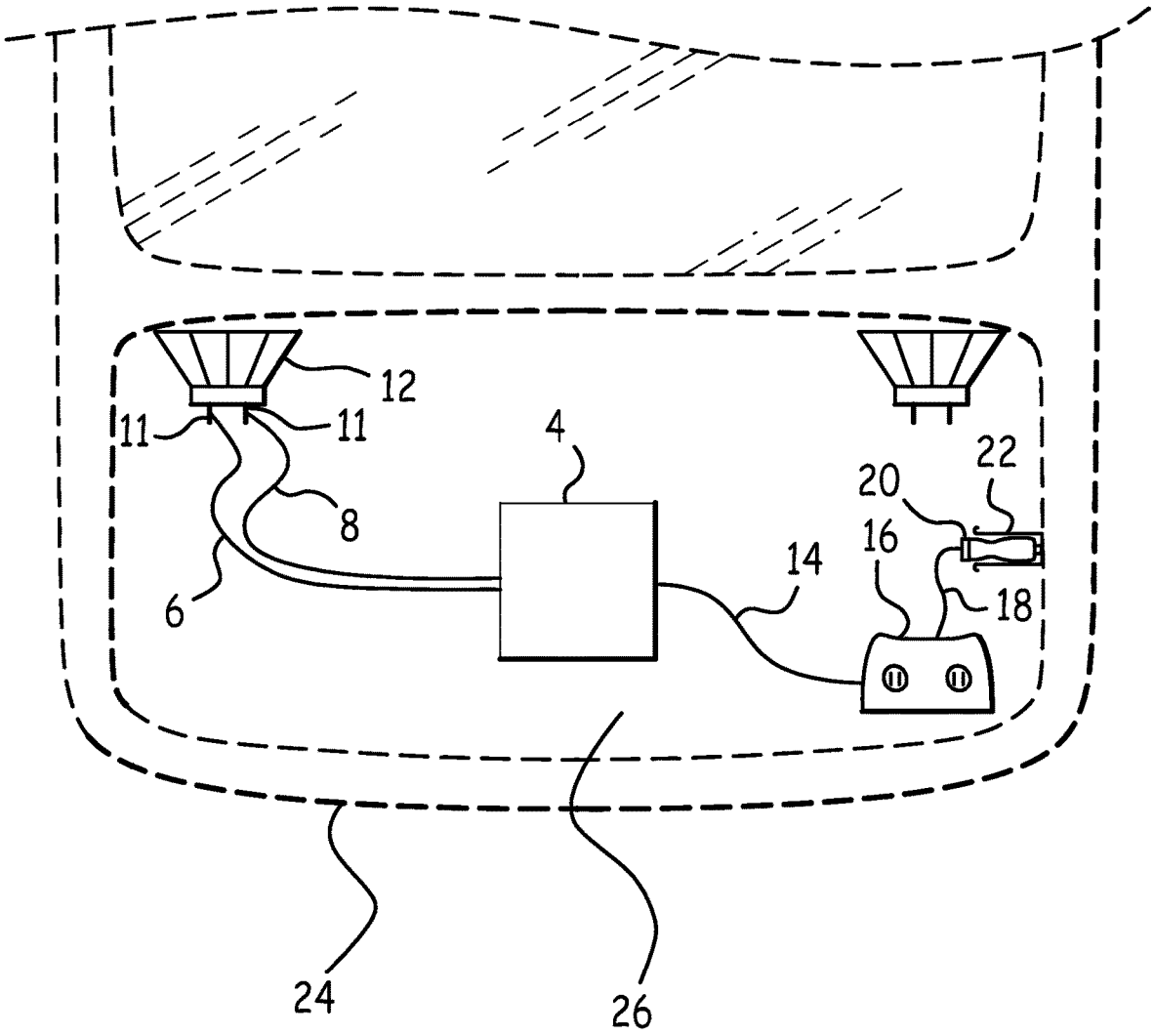
FIG. 2 is a top view of a vehicle subwoofer system installed in a vehicle trunk.

FIG. 2 is a top view of vehicle subwoofer system 2 installed in a vehicle trunk 26. Many currently available vehicles incorporate a DC power source 22 in their trunks 26. Inverter 16 may be plugged into such DC power source 22 using the inverter's DC power line 18 terminating in the inverter's DC power plug 20. In the preferred embodiment, inverter 16 was a commercially available 12 volt DC to 110 volt AC inverter, e.g. in the 350 watt power range.

The powered subwoofer 4 power line 14 terminates in AC plug 15, which may be quickly and easily plugged into an inverter AC receptacle 17. In this manner, powered subwoofer 4 is quickly and easily connected to the vehicle's DC power source 22 using the inverter's DC power plug 20, and the powered subwoofer's AC plug 15 plugged into an inverter AC receptacle 17. DC power source 22 may be a DC power receptacle, which are increasingly being built into vehicles 24 for the convenience of the vehicle 24 users.

While the above description describes a subwoofer system 2 installed in a vehicle trunk 26, attached to the speaker contacts 11 of a rear speaker 12, it is intended to fall within the scope of this disclosure that the instant subwoofer system 2 be installed in any location on a vehicle, connected to any available speaker contacts 11 of a vehicle speaker 12.

Accordingly, the instant method of use for a vehicle subwoofer system comprises the steps of: A. Providing a vehicle having a speaker with speaker contacts 11 and a DC power source 22, an input line assembly having a first end and a second end, a powered subwoofer 4 having audio input 5 and AC power line 14, and an inverter 16 having an inverter AC receptacle 17 and DC power line 18; B. Electrically connecting a first end of the input line assembly 28 to the speaker contacts 11; C. Electrically connecting a second end of the input line assembly 28 to the powered subwoofer audio input 5; D. Electrically connecting the powered subwoofer AC power line 14 to the inverter AC receptacle 17; and E. Electrically connecting the inverter DC power line 18 to the vehicle DC power source 22.

The instant method of use for a subwoofer system may include the further steps of: F. Providing an input line assembly having a positive input wire 6 and a negative input wire 8, an alligator clip 10 electrically attached to a first end of the positive input wire 6, and an alligator clip 10 electrically attached to a first end of the negative input wire 8; G. Electrically connecting the positive input wire 6 to a speaker contact 11 by clipping its alligator clip 10 to one of the speaker contact 11; and H. Electrically connecting the negative input wire 8 to a speaker contact 11 by clipping its alligator clip 10 to one of the speaker contact 11.

The instant method of use for a subwoofer system may include the further steps of providing an audio plug 30, electrically connecting a second end of the positive input wire 6 to the audio plug 30, electrically connecting a second end of the negative input wire 8 to the audio plug 30, and plugging the audio plug 30 into the subwoofer audio input.

The instant method of use for a subwoofer system may include the further steps of providing a DC power source 22 which is a DC power receptacle in the vehicle, and a DC power plug 20 electrically connected to an end of the inverter DC power line 18 opposite the inverter 16; and electrically connecting the DC power line 18 to the DC power source 22 by plugging the DC power plug 20 into the DC power receptacle.

The instant method of use for a subwoofer system may include the further steps of providing an AC plug 15 electrically connected to an end of the AC power line 14 opposite the powered subwoofer 4, and an inverter AC receptacle 17 on the inverter 16; and electrically connecting the AC power line 14 to the inverter 16 by plugging the AC plug 15 into the inverter AC receptacle 17.

Following the above method steps, when an audio signal such as a musical audio signal is played through speaker 12, such audio signal is transmitted through input line assembly 28 to powered subwoofer 4 and amplified, with powerful bass sound re-enforcement. Thus, a listener may listen to the sound signal amplified by powered subwoofer 4 derived from speaker 12 through speaker contacts 11.

In the figures, powered subwoofer 4 is illustrated as being electrically connected to a single speaker 12 through input line assembly 28. This arrangement is generally sufficient to produce a pleasing bass sound reinforcement through powered subwoofer 4. Stereo vehicle sound systems typically have two rear speakers 12, each emitting a channel, e.g. left and right channels. Powered subwoofer 4 may be connected to either speaker 12 as described above.

If additional bass sound reinforcement depth and range is desired, one vehicle subwoofer system 2 may be electrically connected to one speaker 12, and another vehicle subwoofer system 2 may be electrically connected to another speaker 12, as described above.

In the preferred embodiment, powered subwoofer 4 was a commercially available powered subwoofer with AC power line 14 and audio inputs 5, such as a 100 watt peak power self-contained powered subwoofer designed to be powered by 110 volts alternating current (AC). Inverter 16 was a commercially available self-contained inverter with built-in DC power line 18 and inverter AC receptacles 17, such as a 350 watt inverter. Alligator clips 11, positive input wire 6, negative input wire 8, and audio plug 30 were commercially available items. Vehicle 24 having speaker(s) 12 with speaker contacts 11, and trunk 26, was as existing vehicle such as is commonly available on the market.

While a preferred embodiment of the invention has been illustrated herein, it is to be understood that changes and variations may be made by those skilled in the art without departing from the spirit of the appending claims.

DRAWING ITEM INDEX

2 subwoofer system
4 powered subwoofer
5 audio input
6 positive input wire
8 negative input wire
10 alligator clip
11 speaker contact
12 speaker
14 AC power line
15 AC plug
16 inverter
17 inverter AC receptacle
18 DC power line
20 DC power plug
22 DC power receptacle
24 vehicle
26 trunk
28 input line assembly
30 audio plug

I claim:

1. A retrofit trunk confined vehicle subwoofer system for an existing vehicle speaker system comprising:

an audio signal;

a vehicle having a DC power source being located in the trunk;

the vehicle having at least two speakers;

the at least two speakers each having speaker contacts being located in the trunk;

at least two input line assemblies being located in the trunk;

at least two powered subwoofers in the trunk, each comprising an audio input electrically connected to one of the at least two input line assemblies, and to an AC power line; and an inverter electrically connected to said AC power line and to a DC power line;

wherein each input line assembly of the at least two input line assemblies comprises a positive input wire, a negative input wire, an alligator clip electrically attached to a first end of said positive input wire, and an alligator clip electrically attached to a first end of said negative input wire;

wherein each input line assembly electrically connects one powered subwoofer of the at least two powered subwoofers to the speaker contacts of one speaker of the at least two speakers;

wherein the speaker contacts of each speaker of the at least two speakers are electrically connected to only one input line assembly of the at least two input line assemblies;

wherein an end of each said positive input wire and an end of each said negative input wire are is electrically connected to said speaker contacts in the trunk;

wherein said DC power line being electrically connected to said DC power source in the trunk;

wherein each said positive input wire is electrically connected to said speaker contacts by means of its respective said alligator clip being clipped onto one said speaker contact, and wherein each said negative input wire is electrically connected to another said speaker contact by means of its respective said alligator clip being clipped onto another said speaker contact;

wherein each speaker contact is electrically connected to no more than one powered subwoofer of the at least two powered subwoofers;

wherein each of the at least two powered subwoofers operate independently of and in unison with the one or more other powered subwoofers;

an AC plug electrically connected to an end of said AC power line opposite said powered subwoofer, and at least two inverter AC receptacles on said inverter;

wherein said AC plug being plugged into one of the at least two inverter AC receptacles; wherein the at least two inverter AC receptacles electrically connects to the at least two powered subwoofers;

wherein the at least two speakers and the at least two powered subwoofers reproduce audio in unison from the audio signal.

2. The retrofit trunk confined vehicle subwoofer system for an existing vehicle speaker system of claim 1 further comprising the at least two input line assemblies that each further provide an audio plug electrically connected to a second end of said positive input wire and to a second end of said negative input wire.

3. The retrofit trunk confined vehicle subwoofer system for an existing vehicle speaker system of claim 1 further comprising a DC power plug electrically connected to an end of said inverter DC power line opposite said inverter, wherein said DC power source is a DC power receptacle in said vehicle, and said DC power plug is plugged into said DC power receptacle.

4. A retrofit trunk confined vehicle subwoofer system comprising:

an audio signal;

a vehicle comprising a DC power source and a vehicle trunk including at least two speakers with speaker contacts therein;

said DC power source being provided in said vehicle trunk;

at least two powered subwoofers in said vehicle trunk each comprising an audio input; and an AC power line;

an input line assembly provided by each powered subwoofer of the at least two powered subwoofers in said vehicle trunk;

each audio input electrically connected to a separate and distinct input line assembly;

an inverter in said vehicle trunk electrically connected to a DC power line and to said AC power line; and wherein each speaker of the at least two speakers is electrically connected to one of the at least two input line assemblies in said vehicle trunk, such that each said input line assembly is in direct contact with said speaker contacts, and said DC power line being electrically connected to said DC power source in said vehicle trunk;

wherein each speaker contact is electrically connected to no more than one powered subwoofer of the at least two powered subwoofers;

wherein each of the at least two powered subwoofers operate independently of and in unison with the one or more other powered subwoofers;

an AC plug electrically connected to an end of said AC power line opposite said powered subwoofer, and at least two inverter AC receptacles on said inverter;

wherein said AC plug being plugged into one of the at least two inverter AC receptacles;

wherein the at least two inverter AC receptacles electrically connects to the at least two powered subwoofers;

wherein said DC power line comprises a DC power plug at an end of said DC power line opposite said inverter; and wherein said vehicle DC power source is a DC power receptacle sized to admit said DC power plug, said DC power plug being plugged into said DC power receptacle;

wherein the at least two speakers and the at least two powered subwoofers reproduce audio in unison from the audio signal.

5. The retrofit trunk confined vehicle subwoofer system of claim 4 wherein the at least two input line assemblies each comprises a positive input wire, a negative input wire, an alligator clip electrically attached to a first end of said positive input wire, and an alligator clip electrically attached to a first end of said negative input wire, each of the at least two input line assemblies being electrically connected to the audio input of one of the at least two powered subwoofers by means of each said alligator clip being clipped onto a respective said speaker contact.

6. The retrofit trunk confined vehicle subwoofer system of claim 5 further comprising an audio plug electrically connected to a second end of said positive input wire and to a second end of said negative input wire, said audio plug being plugged into said audio input of one of the at least two powered subwoofers.

* * * * *